United States Patent [19]

Keem et al.

[11] Patent Number: 4,834,811

[45] Date of Patent: May 30, 1989

[54] METHOD OF MANUFACTURING, CONCENTRATING, AND SEPARATING ENHANCED MAGNETIC PARAMETER MATERIAL FROM OTHER MAGNETIC CO-PRODUCTS

[75] Inventors: John Keem, Bloomfield Hills; Jun S. Im, Detroit, both of Mich.

[73] Assignee: Ovonic Synthetic Materials Company, Troy, Mich.

[21] Appl. No.: 63,936

[22] Filed: Jun. 19, 1987

[51] Int. Cl.[4] ..... H01F 1/02

[52] U.S. Cl. ..... 148/101; 75/0.5 C; 164/463; 164/477; 209/8; 209/214; 209/215; 241/24; 241/79.1

[58] Field of Search ..... 209/8, 214, 215; 164/463, 477; 241/24, 79.1; 148/101; 75/0.5 C

[56] References Cited

U.S. PATENT DOCUMENTS 2,954,122 9/1960 Colburn ..... 209/8
3,684,090 8/1972 Kilbride ..... 209/214
4,478,711 10/1984 Cohene et al. ..... 209/214

OTHER PUBLICATIONS

Davis, C. W., "Practical Aspects of Alternating-Current Magnetic Separation", RI 3268 Bureau of Mines, Feb. 1935.

*Primary Examiner*—John P. Sheehan
*Attorney, Agent, or Firm*—Richard M. Goldman; Marvin S. Siskind; Kenneth M. Massaroni

[57] ABSTRACT

Disclosed is a method for separating initially non-magnetized ferromagnetic material. The material has a distribution of magnetic parameters, and is separated into a first fraction having relatively high magnetic parameters and a second fraction having relatively low magnetic parameters. The method comprises applying a magnetic field to the materials, the magnetic field being high enough to magnetize the low magnetic parameter fraction, but low enough to avoid substantial magnetization of the high parameter fraction. Thereafter the fractions of material are magnetically separated.

3 Claims, 5 Drawing Sheets

METHOD OF MANUFACTURING, CONCENTRATING, AND SEPARATING ENHANCED MAGNETIC PARAMETER MATERIAL FROM OTHER MAGNETIC CO-PRODUCTS

FIELD OF THE INVENTION

The invention relates to methods of manufacturing enhanced magnetic parameter, isotropic permanent magnetic alloy materials.

BACKGROUND OF THE INVENTION

There has long been a need for a relatively inexpensive, strong, high performance, permanent magnet. Such high performance permanent magnets would be characterized by relatively high magnetic parameters, e.g. coercive force ($H_c$) or coercivity, remanent magnetization or remanence, and maximum energy product. Much inventive effort has gone into the development of high performance permanent magnets satisfying these criteria. Most of this effort has gone into development of the transition metal- rare earth-boron type system, the hard magnetic materials having a tetragonal crystal structure with a $P4_2/mnm$ space group, exemplified by the $Fe_{14}Nd_2B$-type materials.

An ideal high-performance permanent magnet should exhibit a square magnetic hysteresis loop. That is, upon application of an applied magnetic field H greater than the coercive force Hc, all of the microscopic magnetic moments should align parallel to the direction of the applied force to achieve the saturation magnetization Ms. Moreover, this alignment must be retained not only for H=O (the remanent magnetization Mr), but also for a reverse applied magnetic force of magnitude less than Hc. This would correspond to a maximum magnetic energy product (the maximum negative value of BH) of ($Mr^2/4$). Unfortunately, this ideal situation is at best metastable with respect to the formation of magnetic domains in other directions, which act to reduce Mr and $(BH)_{max}$.

E. C. Stoner and E. V. Wohlfarth, Phil. Trans. Royal Soc. (London), A. 240, 599 (1948) have calculated the hysteresis loop for permanent magnets with various orientations of the "easy axis of magnetization," that is, the c axis, with respect to the direction of an arbitrary applied magnetic field, that is, z. For an ideal array of randomly oriented non-interacting uniformly magnetized particles, i.e., an isotropic array, there is no dependence of the hysteresis loop on the direction of the applied field. The maximum theoretical value of the energy product of such a loop is dependent on $M_s$ and $H_c$. If $M_s$ is chosen to equal 16 kilogauss and $H_c$ is chosen to be much greater than $M_s$, then the maximum energy product is less than 16 megagaussoersteds. This is consistent with the observation of the prior art.

Contrary to the limited but negative teachings of the prior art, we have been able to utilize interactions between crystallites to achieve enhanced magnetic parameters in bulk solid materials, as described in our commonly assigned, copending U.S. Application Ser. No. 893,516, filed Aug. 5, 1986 for Enhanced Remanence Permanent Magnetic Alloy And Bodies Thereof, now abandoned incorporated herein by reference.

By "enhanced parameter" materials are meant ferromagnetic materials characterized by magnetic parameters, especially coercivity, remanence, and energy product, greater than those predicted by Stoner & Wohlfarth for non-interacting systems. These materials have a short range local order characterized by the mean crystallographic grain size, the crystallographic grain size range, and the crystallographic grain size distribution all being within narrow ranges. The grain size, grain size distribution, and grain size range are correlated with the observed enhanced magnetic parameters and are believed to be associated with magnetic interactions between adjacent grains across grain boundaries.

The above application, and its parent, U.S. Application Ser. No. 816,778, now abandoned, also incorporated herein by reference, describe a class of permanent magnetic alloys which exhibit enhanced magnetic parameters, especially remanence and energy product, as measured in all spatial directions, that is, isotropically. The magnetic parameters are of a magnitude which the prior art teaches to be only attainable in one spatial direction, that is, anisotropically, and to be only attainable with aligned materials.

These enhanced parameter alloy materials of our commonly assigned copending applications, Ser. Nos. 816,778 and 893,516, do not obey the Stoner and Wohlfarth assumptions of non-interacting particles. To the contrary, the individual particles or crystallites interact across grain boundaries. This interaction is consistent with ferromagnetic exchange type interaction presumably mediated by conduction electrons.

The enhanced parameter alloy is a substantially crystallographically unoriented, substantially magnetically isotropic alloy, with apparent interaction between adjacent crystallites. By substantially isotropic is meant a material having properties that are similar in all directions. Quantitatively, substantially isotropic materials are those materials where the average value of [Cos (theta)], defined above, is less than about 0.75 in all directions, where Cos (theta) is averaged over all the crystallites.

The enhanced parameter magnetic materials are permanent (hard) magnets, with isotropic maximum magnetic energy products greater than 15 megagaussoersteds, coercivities greater than about 8 kilooersteds at standard temperature (23° C. to 27° C.), and isotropic remanences greater than about 8 kilogauss, and preferably greater than above about 11 kilogauss.

The enhanced parameter magnetic material is composed of an assembly of small crystalline ferromagnetic grains. The grains are in intimate structural and metallic contact along their surfaces, i.e., along their grain boundaries. The degree of magnetic enhancement above the upper limits predicted by Stoner and Wohlfarth is determined by the size, size distribution and size range of the grains relative to a characteristic size, $R_0$.

While the interaction across grain boundaries and concommitant enhancement of properties has been quantitatively described in the above applications with respect to rare earth-transition metal-boron materials of tetragonal, $P4_2/mnm$ crystallography, especially the $Nd_2Fe_{14}B_1$ type materials having a characteristic size, Ro, of about 200 Angstroms, this is a general phenomenon applicable to other systems as well. The optimum characteristic size, $R_o$, however, may be different in these other cases, as is described in our commonly assigned, copending U.S. Application Ser. No. 893,516, incorporated herein by reference.

In one exemplification of our commonly assigned, copending U.S. Application Ser. No. 893,516 the magnetic alloy material is an alloy of iron, optionally with other transition metals, as cobalt, a rare earth metal or metals, boron, and a modifier. In another exemplification the magnetic alloy material is an alloy of a ferromagnetic transition metal as iron or cobalt, with a lanthanide, as samarium, and a modifier.

A modifier is an alloying element or elements added to a magnetic material which serve to improve the isotropic magnetic properties of the resultant material, when compared with the unmodified material, by an appropriate processing technique. Exemplary modifiers are silicon, aluminum, and mixtures thereof. It is possible that the modifier acts as a grain refining agent, providing a suitable distribution of crystallite sizes and morphologies to enhance interactions.

The amount of modifier is at a level, in combination with the quench parameters, to give the above described isotropic magnetic parameters.

The enhanced parameter magnetic alloy may be of the type

[Rare Earth Metal(s)]-[Transition Metal(s)]-[Modifier(s)], for example

[Sm]-[Fe,Co]-[Si,Al].

Another interacting alloy may be of the type

[Rare Earth Metal(s)]-[Transition Metal(s)]-Boron-[modifier(s)], for example

[Rare Earth Metal(s)]-[Fe,Co]-Boron-[modifier(s)], and [Rare Earth Metal(s)]-[Fe,Co,Mn]-Boron-[modifier(s)].

In one exemplification, the magnetic alloy material has the stoichiometry represented by:

$(Fe,Co,Ni)_a(Nd,Pr)_bB_c(Al,Si)_d$, exemplified by $Fe_a(Nd,Pr)_bB_c(Al,Si)_d$, where a, b, c, and d represent the atomic percentages of the components iron, rare earth metal or metals, boron, and silicon, respectively, in the alloy, as determined by energy dispersive spectroscopy (EDS) and wave length dispersive spectroscopy (WDS) in a scanning electron microscope. The values for these coefficients are:

$$a+b+c+d=100;$$

a is from 75 to 85;

b is from 10 to 20, and especially from 11 to 13.5;

c is from 5 to 10;

and d is an effective amount, when combined with the particular solidification or solidification and heat treatment technique to provide a distribution of crystallite size and morphology capable of enhancement of magnetic parameters, e.g., from traces to 5.0.

The rare earth metal is a lanthanide chosen from neodymium and praseodymium, optionally with other lanthanides (one or more La, Ce, Sm, Eu, Gd, Tb, Dy, Ho, Er, Tm, Yb and Lu), Sc, Y, and mixtures thereof present. While various combinations of the rare earth metals may be used without departing from the concept of this invention, especially preferred rare earth metals are those that exhibit one or more of the following characteristics: (1) the number of f-shell electrons is neither 0 (as La), 7 (as Gd) or 14 (as Lu), (2) low molecular weight lanthanides, such as La, Ce, Pr, Nd, and Sm, (3) high magnetic moment lanthanides that couple ferromagnetically with iron, as Nd and Pr, or (4) relatively inexpensive lanthanides, as La, Ce, Pr, and Nd. Especially preferred are Nd and Pr. Various commercial and/or byproduct mischmetals may be used. Especially preferred mischmetals are those rich in Nd and/or Pr.

The preferred means of producing the above described, enhanced parameter, magnetic alloy having magnetic isotropy and the above short range order and/or crystallographic properties and dimensions is by melt spinning, i.e., rapidly solidifying and quenching molten alloy material onto a moving chill surface, e.g., a rotating chill surface means substantially as shown in commonly assigned, copending U.S. Application Ser. No. 816,778.

The quench parameters may be controlled to direct the solidification front, control its velocity, and control grain coarseness.

The alloy is quenched at an appropriate rate to result in morphological, crystallographic, atomic, and/or electronic structures and/or configurations that give rise to the novel enhanced magnetic parameters. The quench parameters are carefully controlled to produce flakes of a high fraction of an appropriate fine grained structure, which, together with the aforementioned modifier, results in the desired permanent magnet material.

These flakes are much larger than the characteristic crystallographic grain size, $R_o$. A typical flake may contain at least $10^8$ grains of characteristic grain size $R_o$.

Individual melt spun fragments are recovered as particulate flake product from the melt spinning process. Individual particles can also be obtained by the comminution of the ribbon fragments which are generally relatively brittle. The ribbon fractures, yielding smaller particles, e.g., flake like particles, or plate like individual particles.

As described above these enhanced magnetic parameter materials are synthesized in processes that require chemical and structural modifiers, and rapid solidification. The modifiers and rapid solidification synergistically interact to provide solidification and crystallization pathways that result in the short range local order and/or crystallographic grain sizes identified with enhanced parameters, e.g., remanence and energy product.

However, a significant problem is the effect of quench transients on the short range order, and, as a result, on the final magnetic properties. These transients may be of such short duration that a material is obtained having a distribution of short range local orders and/or crystallographic grain sizes and magnetic parameters in close proximity.

The short range local order of the enhanced parameter materials is a strong function of the instantaneous and time averaged local cooling rate (temperature change per unit time) and the instantaneous and time averaged thermal flux (energy per unit time per unit area). The solidification and crystallization processes occur with initial cooling rates of 100,000 to 1,000,000 degrees Celsius per second, and average temperature drops (temperature drop while on the chill surface divided by residence time on the chill surface) of 10,000 to 100,000 degrees Celsius per second. These cooling rates drive local instantaneous heat fluxes of hundreds of thousands of calories per square centimeter per second, and average heat fluxes of 10,000 to 100,000 calories per square centimeter per second. Within this cooling rate and heat flux regime, local, short duration upsets, transients, and excursions, as induction heating eddy currents, formation and passage of alloy-crucible reaction products (slags and oxides) through the crucible orifice, and even bubbles of inert propellant gases as argon, and the like, result in a particulate product containing a range of particle sizes, crystallographic grain sizes, and particle magnetic parameters ranging from overquenched to underquenched. When referring to the ribbon and/or flake product of the quench surface, the particle size correlated parameters are correlated primarily with the ribbon or flake thickness, and secondarily wifh the ribbon or flake width. By "particle size" we mean ribbon or flake thickness.

Short range local order and/or the crystallographic grain size determines the magnetic parameters. Quench rate, i.e., cooling rate, and thermal flux, determine the short range local order. The ribbon or flake thickness, primarily, and width, secondarily, which we refer to as the ribbon or flake particle size is also correlated, to a first approximation, with the quench rate and the thermal flux. Thus, it is possible to effect a partial separation and an increased concentration of enhanced parameter materials by particle size (i.e., thickness and width) classification alone. However, particle size classification alone results only in a separation of (1) a fraction enriched in over quenched and enhanced parameter materials from (2) a fraction enriched under quenched material. This is a minimally efficient process, the resulting recovered product being slightly enriched in enhanced parameter material, but behaving macroscopically as overquenched material.

By "under quenched" materials are meant those materials having a preponderance of crystallographic grains larger than the grain sizes associated with enhanced magnetic parameters.

By "over quenched" materials are meant those materials having a preponderance of crystallographic grains smaller than the grain sizes associated with enhanced magnetic parameters. These are generally very low energy product materials. In some circumstances these overquenched materials can be heat treated to attain enhanced parameters.

SUMMARY OF THE INVENTION

These problems are obviated by the method of the invention which allows separation of enhanced parameter material from the low magnetic parameter material, i.e., both over quenched and under quenched materials, and especially underquenched materials. Enhanced parameter ferromagnetic alloys, exemplified by $RE_2Fe_{14}B_1$ type alloys, as $RE_2Fe_{14}B(Si,Al)$, and $Nd_2Fe_{14}B(Si,Al)$ having chemical and structural modifiers which, in combination with quench parameters provide a quenched particulate product composed of crystallographic grains having the short range local order and/or crystallographic grain size necessary for interaction.

The rapid solidification process results in production of flake-like and plate-like particles having a distribution of sizes. The distribution of short range local orders and/or crystallographic grain sizes within a particle is, to a first approximation, correlated with the particle size. According to the invention ferromagnetic alloy particles are separated into portions, at least one of which is enriched in enhanced parameter material content and at least one of which is depleted in enhanced parameter material content, and the portion enriched in enhanced parameter material content is recovered as a product.

Other portions, e.g., depleted in enhanced parameter material content and enriched in either over quenched material or under quenched material may be further processed. For example overquenched material may be heat treated and/or underquenched material may be remelted.

According to the invention there is provided a method of separating non-magnetized ferromagnetic material having a distribution of magnetic properties at complete magnetization into:

(1) a first fraction having relatively high magnetic parameters at complete magnetization, e.g., an enhanced parameter fraction;

(2) a fine grain, second fraction having relatively low magnetic properties at complete magnetization, i.e., an over quenched fraction, and optionally, (3) a coarse grain, third fraction having relatively low magnetic parameters at complete magnetizations, i.e., an under quenched fraction.

The method comprises applying a magnetic field to the materials. This applied magnetic field is carefully controlled to be:

(1) low enough to avoid substantial magnetization of the enhanced magnetic parameter first fraction; but (2) high enough to magnetize the low magnetic property second fraction, e.g., the over quenched material.

Thereafter the material is separated into portions, the enhanced parameter first portion by mechanical separation e.g., separation dependent on size, shape, density or the like, and the second, low parameter portion by magnetic separation, e.g., separation based on differences in magnetic characteristics, for example, these magnetic characteristics referred to by chemical process practitioners as "magnetic attractability".

We have found that the "enhanced parameter" and overquenched materials of like particle size, that is, within the same intermediate "cut" may be magnetically separated from one another, with the "overquenched" material magnetically separated from the "enhanced parameter" material. This is accomplished by applying a magnetic field to classified, non-magnetized particles, that is, for example, to the intermediate particle size cut of the particulate solid alloy. The magnetic field must be low enough to avoid substantial magnetization of the "enhanced parameter" material, i.e., with high saturation magnetic parameters, but high enough to at least partially magnetize the "overquenched" low saturation magnetic property material.

This allows mechanical separation of a first portion primarily composed of "enhanced parameter," high complete magnetization magnetic property first fraction particles, and magnetic separation of a second portion composed of "overquenched," low complete magnetization magnetic property second fraction particles.

THE FIGURES

The invention may be understood by reference to the FIGURES.

DETAILED DESCRIPTION OF THE INVENTION

Figure 1:
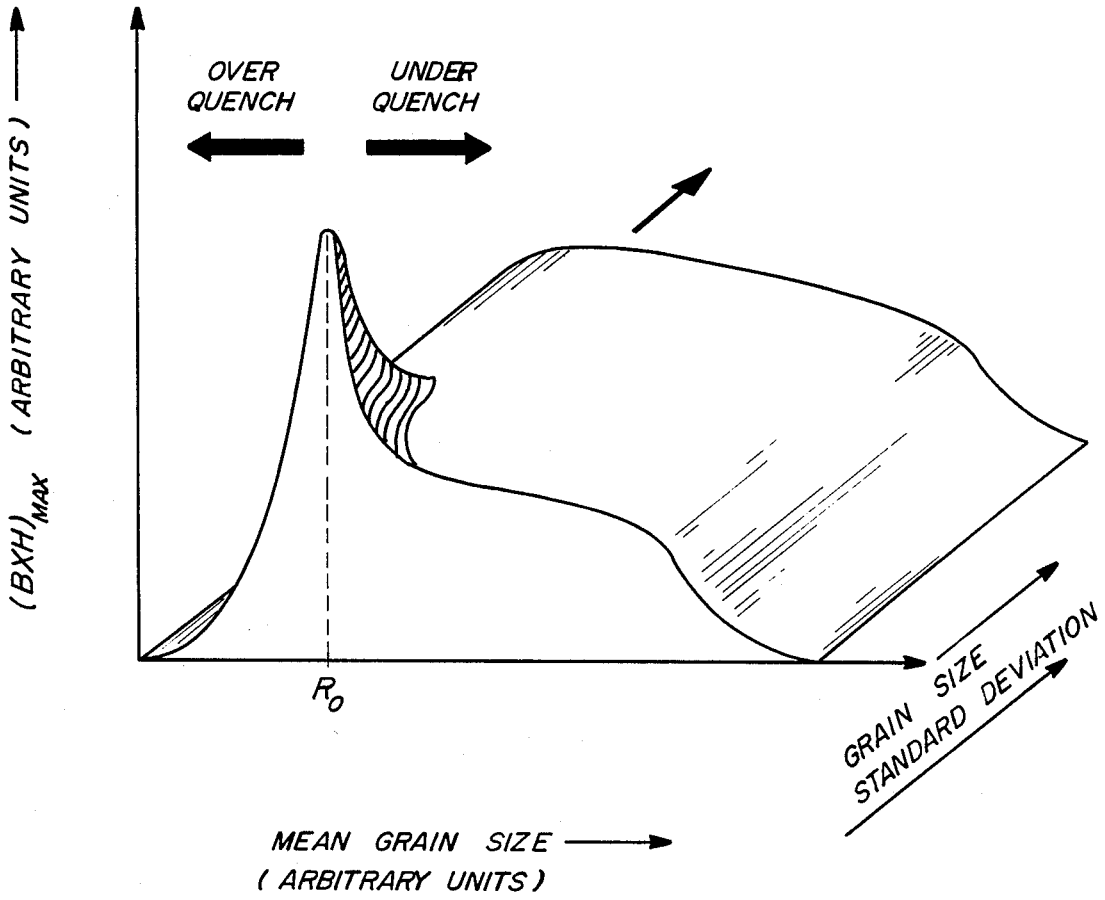
FIG. 1 is a representation of a distribution curve showing a magnetic parameter, as maximum energy product, versus mean grain size and grain size standard distribution.

The presence of enhanced magnetic parameters is a short range phenomena, dependent on the presence of morphological, crystallographic, atomic, and electronic structures and/or configurations that are associated with the enhanced magnetic parameters. These enhanced magnetic parameters, as coercivity, remanence, and energy product are strongly correlated with the grain size, grain size range, and grain size distribution. FIG. 1 is a graphical representation of the relationship between one magnetic parameter, the maximum magnetic energy product (in arbitrary units) as a function of two measures of crystal morphology, the mean grain size (in arbitrary units) and the standard deivation of the grain size (in arbitrary units).

FIG. 1 shows that, in accordance with the interaction model described in our commonly assigned, copending U.S. Application Ser. No. 893,516, there is a critical range of mean crystallographic grain size and crystallographic grain size standard deviation that gives rise to enhanced parameters. Interaction and the enhanced properties associated therewith are not observed outside of these narrow ranges.

As seen in FIG. 1, mean grain sizes smaller then Ro result in an "over quenched" material, and larger mean grain sizes result in an "under quenched" material. The as-solidified material contains a distribution of particle sizes and crystallographic grain sizes.

The invention described herein provides a method of separating mixtures of initially non-magnetized ferromagnetic material having a distribution of magnetic properties at complete magnetization into a first fraction having relatively high magnetic properties at complete magnetization and a second fraction have relatively low magnetic properties at complete magnetization. The method contemplates applying a low strength magnetic field to the materials. The magnetic field is high enough to magnetize the low complete magnetization magnetic property second fraction, e.g., the over quenched material, but low enough to avoid substantial magnetization of the high complete magnetization property, enhanced parameter first fraction. The field is low enough that the induced magnetization of the enhanced parameter, interacting material is below the induced magnetization of the conventional, non-interacting material. Thereafter the fractions are separated based upon the difference in induced magnetic properties. This may be accomplished by magnetically separating the second fraction and/or mechanically separating the first fraction.

The method is especially applicable to manufacture of magnetic materials by melt spinning. In melt spinning a stream of molten alloy is ejected from a crucible, through an orifice onto a moving chill surface, e.g., a rotating chill surface. The quench parameters are controlled to direct the solidification front, control its velocity, and thereby control the grain size, grain size range, and the grain size distribution. This results in quenching at a rate that results in the short range local order and crystallographic dimensions, i.e., morphological, crystallographic, atomic, and electronic structures and configurations, and crystallographic grain size, grain size range, and grain size distribution, among others, that are identified with the enhanced magnetic parameters.

The product of melt spinning is a particulate flake product. The individual flake like and/or plate like particles are much larger than the crystallographic grain size, $R_o$, with a typical particle or flake containing on the order of $10^8$ crystallographic grains. The collection of individual particles has a distribution of particle sizes, i.e., a first distribution. This distribution of particle sizes is typically from about tens of microns to several millimeters. The particle size is a function of the local quench rate and heat transfer rate.

We have found that while the crystallographic grains within a single particle are frequently (but not always) substantially uniformly sized, within each "cut" of particle sizes there is a distribution of crystallographic grain sizes, i.e., a second distribution of crystallographic grain size between crystals of the same as-solidified size.

We have also found that within a particle or flake there may be regions and/or inclusions of one crystallographic grain size and regions and/or inclusions of another crystallographic grain size, and that the particle or flake may be fractured, crushed, ground, or comminuted to a size smaller than the size of such regions or inclusions, thereby liberating such regions or inclusions for subsequent separation and/or recovery by a crystallographic grain size dependent property, e.g., a magnetic property. In a preferred exemplification the thusly liberated regions or inclusions may be separated into enhanced parameter material and other material by the combined magnetic and mechanical method described herein.

For most particles, the distribution of crystallographic grain sizes contained therein is correlated with particle sizes. The larger particles are comprised of a preponderance of "underquenched" material, with large crystallographic grains, e.g., on the order of 0.1 micron or larger, and the smaller particles are comprised of a preponderance of "overquenched" material, with small crystallographic grains, e.g., on the order of 100 Angstroms or less.

We have further found that there is an intermediate particle size fraction or "cut". Within this fraction the particles, of approximately equal size, are of at least three types; those comprised of a preponderance of "overquenched" material with small crystallographic grains, those comprised of a preponderance of "enhanced parameter" material with a crystallographic grain size and short range order to provide enhanced magnetic parameters, and those comprised of both overquenched material and enhanced parameter material.

Within this intermediate particle size fraction the particle sizes are so similarly sized that it is not possible to separate the "overquenched" materials from the "enhanced parameter" materials by mechanical means (as sieving, screening, settling, cyclonic separation, filtration, floatation, sedimentation, centrifugal separation, or the like).

According to the method of our invention "enhanced parameter" and "overquenched" materials within the intermediate "cut" may be separated from one another, with the "overquenched" material being magnetically separated from the "enhanced parameter" material, and the "enhanced parameter" material being mechanically separated from the "overquenched" material. As shown in the flow chart of FIG. 2 this is accomplished by applying a magnetic field to a uniformly sized, e.g., classified, non-magnetized, intermediate particle size cut of the particulate solid alloy.

Figure 2:
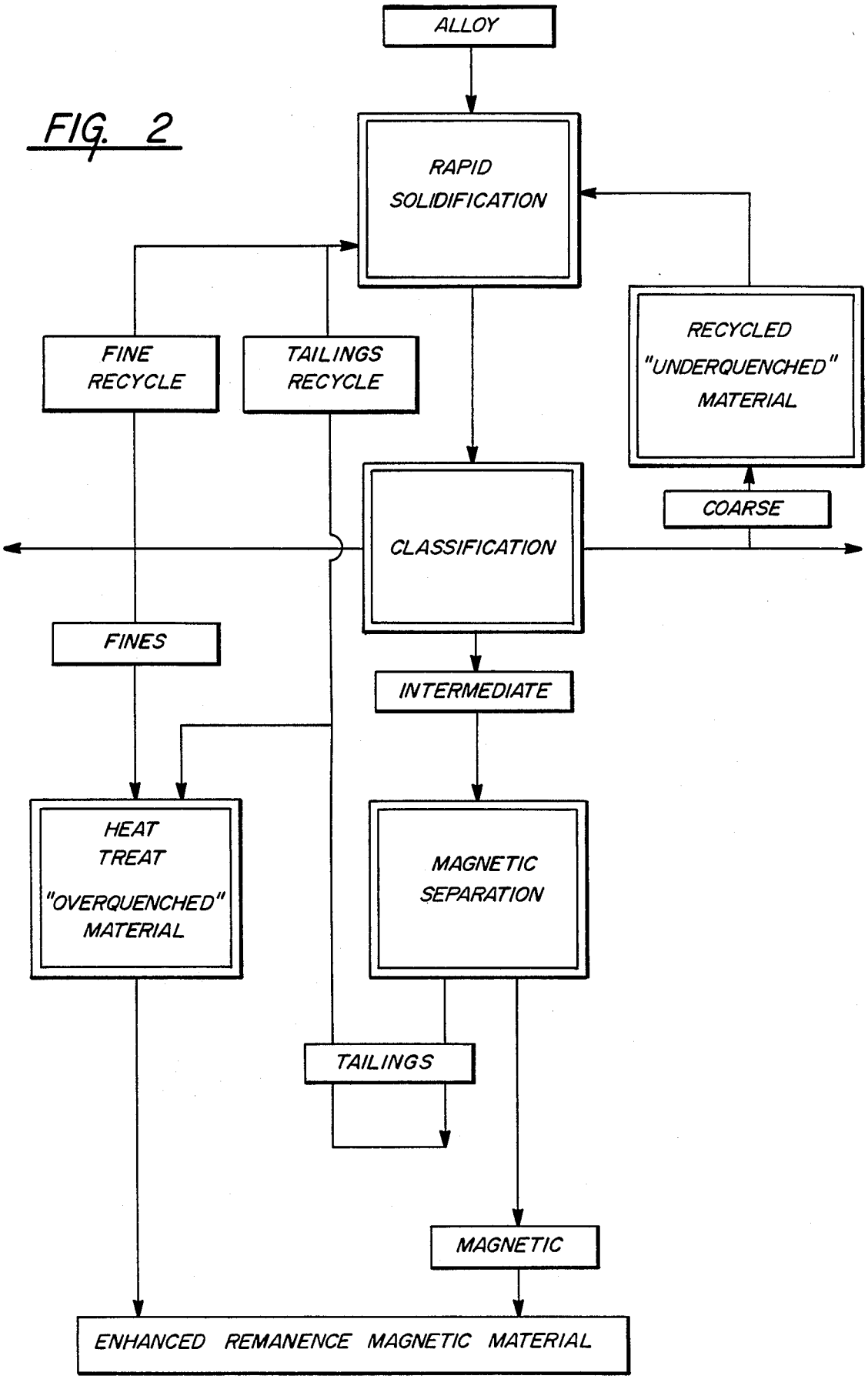
FIG. 2 is a flow chart for the separation process of the invention.

As shown in FIG. 2, a magnetic alloy is solidified from a molten precursor by rapidly solidifying the molten precursor alloy. This results in the formation of a particulate solid alloy having a distribution of particle sizes and a distribution of crystallographic grain sizes and/or short range local orders. As described above, the crystallographic grain sizes and short range local orders are correlated with magnetic parameters.

As the aid in recovery of enhanced parameter material, the particles may be comminuted, e.g., to sub-millimeter size, so as to separate regions rich in enhanced parameter material from regions lean in enhanced parameter material. The particulate solids may be comminuted, e.g., to a size corresponding to or smaller than the size of enhanced parameter inclusions or regions within the particles. This liberates enhanced parameter material that would otherwise be removed with the coarse, under quenched material.

Alternatively, the particulate material may be separated into fractions by size without comminution, so as to utilize the correlation between particle size and crystallographic grain size within the individual particles.

After classification, if any, a magnetic field is applied to the particulate solid or classified portion thereof. The magnetic field has a low enough field strength to avoid substantial magnetization of the enhanced parameter material first fraction having high values of the magnetic properties at complete magnetization, but high enough to effect magnetization of the low complete magnetization magnetic property second fraction.

We have found that in order to effect separation between overquenched and enhanced parameter materials of the $RE_2Fe_{14}B_1$ type (as iron-neodymium-boron-silicon and iron-neodymium-boron-silicon-aluminum ferromagnetic alloys) a simple function of (1) the distance between the electromagnet and the particles and (2) the magnetization in the electromagnet should be such as to obtain separation. This can be readily determined, empirically, for any actual system. Values above the empirically determined range may magnetize too many enhanced parameter particles, resulting in clumping, agglomerating, and removal thereof. Values below this empirically determined range do not remove low parameter flakes.

As shown in FIG. 2, the underquenched, coarse grain material may be utilized as a low energy product commodity, or recycled, i.e., remelted. The fine grain, overquenched material maay be utilized as a low energy product commodity, recycled, or heat treated. FIG. 2 is not intended to be a completely exhaustive flow chart. Specific post-separation utilization of low parameter fractions and degree of separation may be determined by various extrinsic factors, including economic and engineering factors, availability of equipment, raw material and manufacturing costs, product prices, and the like.

The difference in induced magnetic properties, especially the surprisingly lower induced properties in the enhanced parameter material, allows for the magnetic separation of high magnetic parameter particles from low magnetic parameter particles. At the low applied fields herein contemplated the fine grain, overquenched material surprisingly has higher induced magnetization than does the enhanced parameter material.

This difference in induced magnetization allows mechanical separation of a first portion primarily composed of "enhanced parameter," first fraction particles, and magnetic separation of "overquenched," low complete magnetization magnetic property second fraction particles. "Magnetic separation" as used herein means the separation of materials based on a difference in magnetic characteristics, referred to generally as "magnetic attractability." "Magnetic attractability" is defined and described in Warren L. McCabe and Julian C. Smith, *Unit Operations of Chemical Engineering,* Mc-Graw Hiil Book Company, Inc., New York, (1956), at pages 388–391, incorporated herein by reference. One magnetic separation described by McCabe and Smith and R. E. Kirk and D. F. Othmer, *Encyclopedia of Chemical Technology,* (1952) Vol. 8, and useful in carrying out the process herein, is a magnetic pulley. In magnetic separation using a magnetic pulley, a mixture of particles is carried on a belt, as an endless belt or a conveyor belt, to a magnetized rolling surface means, as a magnetized pulley, roller, idler, or wheel. The belt passes around the magnetized rolling surface means. As the belt passes around the rolling surface means the material with low induced magnetization falls from the belt and magnetized rolling surface means, e.g., into collection means, by gravity. The materials of higher induced magnetization remain in contact with the belt because of their attraction toward the magnetized roller means, and are forced off, e.g., by gravity, only when the belt means moves them beyond the field of the magnetized roller means.

An alternative means of magnetic separation, also useful in practising the invention herein, is to place an electromagnet close to a moving stream of the particulate material (e.g., a stream carried by a conveyor belt). Materials of low induced magnetized are carried past the magnet by the stream, while materials of relatively higher induced magnetization are collected on the face of the electromagnet. The electromagnet may be periodically scrapped or de-energized to recover magnetic particles.

Figure 3:
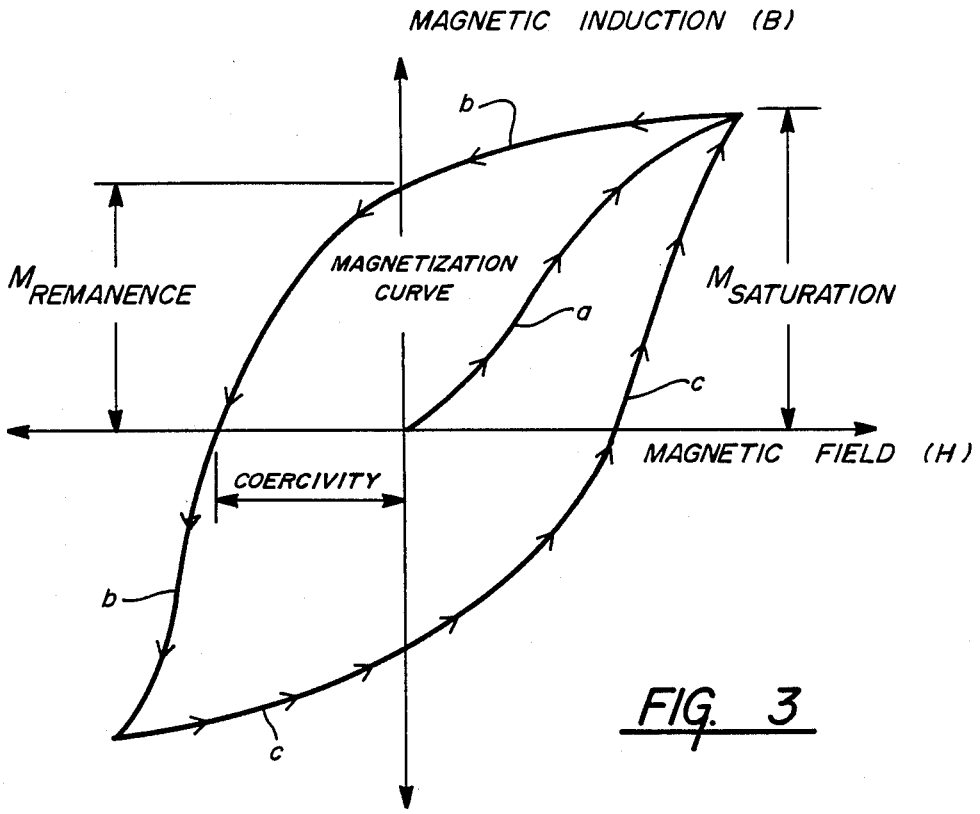
FIG. 3 is a representation of a magnetization curve for a magnetic material.
Figure 4:
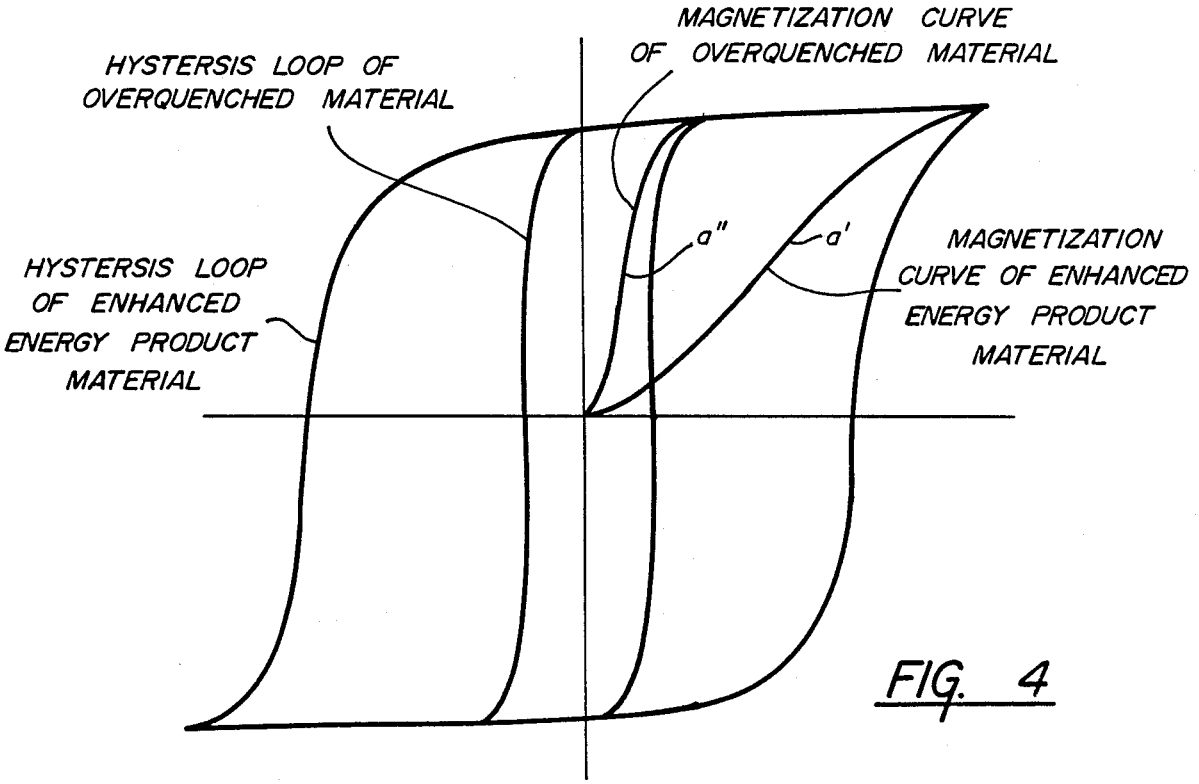
FIG. 4 is a representation of a magnetization curve and hysteresis loop of an overquenched material pictorially superimposed atop a representation of a minor loop and magnetization curve of an enhanced remanence material.
Figure 5:
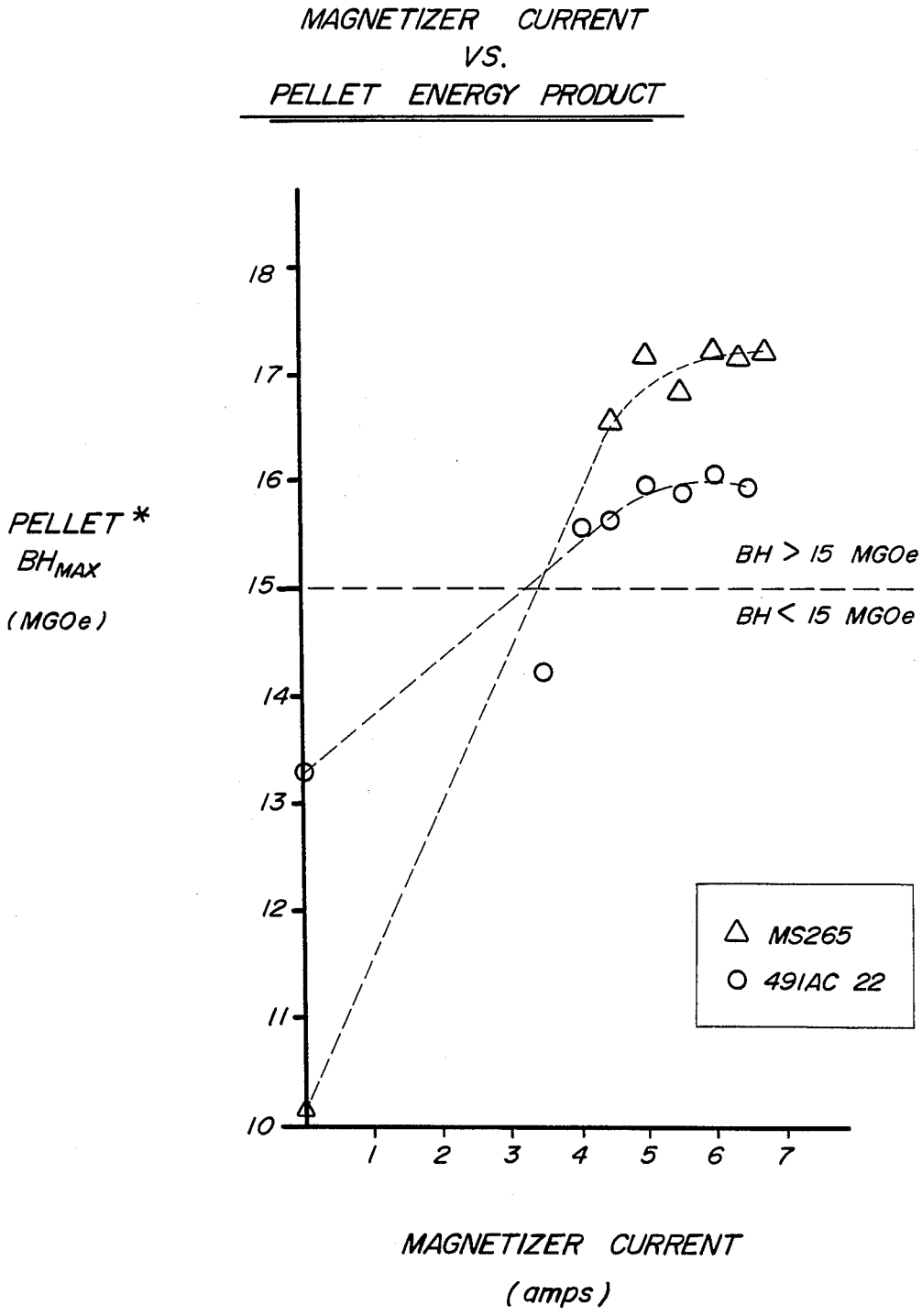
FIG. 5 is a plot of magnetizer current versus energy product for the material of samples MS265 and 491AC22.

The invention can be understood by considering the magnetization curve and hysteresis loop in FIGS. 3, 4, and 5. The magnetization curve shows the relationship between the applied field (H) and the magnetization (M). When the applied field H is initially applied to an un-magnetized (but ferromagnetic) material, the magnetization, M, increases non-linearly, with increasing applied field H along the magnetization curve a. At higher values of H the magnetization curve, a, levels off, i.e., the material becomes completely magnetized. The general shape of the magnetization curve is "S" shaped, which is characteristic of ferromagnetic materials magnetized from an un-magnetized state to complete magnetization.

Once complete magnetization is reached, and the applied field H is reduced to zero, the magnetization, M does not return to the origin along the initial magnetization curve, a. Instead, the induced field declines along curve b to a zero applied field intercept, with a value $M_r$. This is one measure of permanent magnetism, the remanence, i.e., the magnetization of a previously saturated material under the influence of a zero applied field, H. If the applied field, H, is then reversed in direction and increased in absolute value, the curve b reaches a point where the magnetization, M, is reduced to zero.

The value of the applied field, H, at this point is another measure of permanent magnetism, the coercivity, $H_c$, that is, the reverse field necessary to demagnetize a previously magnetized material. On further increasing the applied field, H, a point symmetrical to complete magnetization is reached. If the applied field, H, is now reversed, the magnetization increases back to positive saturation along curve c, and not along the initial magnetization curve a.

The magnetization curve in FIG. 3 depicts the magnetization of a system of many crystals. These crystals have their easy axes of magnetization randomly arrayed. Furthermore, each crystal may have several magnetic domains. As a small applied field, H, is applied to the material, the domain walls begin to move, and the domains which have a favorable direction of easy magnetization grow larger. This growth is reversible as long as the applied field is very small. If the field is removed, the induced magnetization will return to zero at the origin. This is the foot of the "S" shaped curve. This is also within the region where the high parameter material should be maintained during the separation process herein described.

For larger applied fields, H, the process of domain growth is more complicated. Domain wall movement is not smooth or linear with applied field, H. Strains, dislocations, defects, and imperfections stop the movement of the domain walls with increasing applied field. There is a thermodynamic barrier to domain wall movement at these sites, until the applied field, H, exceeds the thermodynamic barrier to domain wall movement. Once this thermodynamic barrier is surpassed, the domain wall moves to the next strain, dislocation, defect, or imperfection, where it again stops until the applied field, H, is high enough for unimpeded motion. This rapid and irregular movement of domain walls produces eddy currents and magnetostrictive effects in the material, which result in irreversibility, i.e., movement along either a saturation or a minor hysteresis loop, b-c, rather then along the magnetization curve, a. It is within this region of its magnetization curve that the overquenched material is magnetized during the separation process herein contemplated.

For still larger fields, after all of the domain walls have been moved and each crystallographic grain has been magnetized in its best direction, there still remain some crystallographic grains that have their easy directions of magnetization not in the direction of the applied field H. It requires a large additional field to align these moments. This is the shoulder of the "S" shaped curve near saturation.

FIG. 4 illustrates how the separation process of the invention takes advantage of the differing "S" shapedness of the initial magnetization curves of the enhanced parameter material and the overquenched material. At the low applied field, H, herein contemplated, the "S" shaped initial magnetization curve a' of the enhanced parameter material has a low slope, dM/dH, (i.e., the derivative of induced magnetization with respect to applied magnetization) and is in the reversible foot. This results in a low induced field. However even at this low field, the initial magnetization curve of the low parameter overquenched material, a'', has a higher slope, dM/dH, and as clearly shown in FIG. 4, at this low applied field the low parameter, overquenched material has higher induced magnetization then does the enhanced parameter material. This allows the magnetic separation of the low parameter material.

FIG. 5 qualitatively illustrates our observation of a general trend of the maximum magnetic energy product for a fully magnetized material, $(BH)_m$, versus magnetic current. The horizontal dotted line at (BH)=15 MGOe represents the (BH) corresponding to enhanced magnetic parameters. B is the magnetic induction, and is B=M+H, where M and H are as defined previously.

The invention maay be understood by reference to the following examples.

A. Summary of Test

In obtaining the results in the following examples, a macroscopically homogeneous ingot (mother alloy) was first prepared by melting together the proper mixture of iron, neodymium, praseodymium, boron, silicon, and aluminum. Thereafter, portions of each ingot were melted and rapidly quenched using melt-spinning to form fragments of ribbon. These as-quenched ribbon samples were then screened into uniformly sized fractions, the overquenched material magnetically separated from the enhanced parameter material, and the remaining material weighed and measured magnetically, generally using a large pulsed field to pre-magnetize the samples. In some cases, the particles were subjected to further heat-treatment and subsequently remeasured magnetically. Some batches of ribbon particle samples were further crushed and compacted (pelletized) into magnetic bodies, and subsequently remeasured magnetically.

B. Preparation of the Ingot (Mother Alloy)

The precursor or mother alloys were generally prepared from the elemental components: iron (99.99% pure electrolytic iron flake), boron (99.7% crystalline boron), Nd and Pr pure rods (99.9% rare earth metals), and silicon (99.99% Si crystals). In some cases, higher purity material was used. In other cases, commercial-grade rare-earth products were used, containing up to 15 weight percent iron and up to several weight % of rare earths other than Nd and Pr. The components were weighed out in appropriate proportions, and melted together either by arc-melting on a cooled copper hearth, or by rf induction heating in a crucible consisting either of fused quartz or sintered magnesium oxide ceramic. Arc-melted samples were melted and turned six times, while induction-melted samples were held at a temperature above about 1400° C. for 30 minutes to 2 hours, with enough churning in the melt to obtain a macroscopically homogeneous alloy. After solidifying and cooling, the ingot was recovered from the crucible, an outer skin of reaction product was removed, and the ingot broken up into particles of characteristic dimension about 1 centimeter. Composition checks were made on samples of the ingot material to check for homogeneity.

C. Preparing the Quenched Material

Preparing the quenched material from the ingot was performed in one of three melt-spinning systems. Two of these are simple box spinners with copper wheels ten inches in diameter and one inch thick (the 10" spinner) and twelve inches in diameter and two inches thick (the 12" spinner), respectively. The chambers are suitable for evacuation and subsequent back-filling with an inert processing atmosphere. The crucible in these spinners is unshielded. In the third system (the 20" spinner), the copper wheel is a shell twenty inches in outer diameter, four inches wide, and three inches thick. This wheel is contained within a chamber continuously flushed with an inert process gas. The crucible is enclosed in a shroud of flowing inert gas. In the counter-rotation direction from the crucible, a flow of inert gas counteracts the gas dragged along by the surface of the wheel. In all three systems, the spinner wheel was typically rotated with a surface velocity in the range between 15 and 30 meters per second.

For the 12" and 20" spinners, the crucible is a clear fused quartz cylinder 45 mmm inside diameter by about 40 cm long, while for the 10" spinner the crucible is similar but with dimensions 17 mmm inside diameter by 25 cm long. The crucible orifice was typically a circular hole in the bottom between 0.5 and 1.5 mmm in diameter, and the crucible was positioned with the orifice 5 to 10 mm from the wheel surface.

Several chunks of ingot alloy were melted in the crucible using a 450 kilohertz induction furnace (or a 10 kHz induction furnace for the 12" spinner) until the desired temperature (typically of order 1200–1300 degrees C.) was reached, as determined using an optical pyrometer. With rf heating still being supplied, the crucible was then pressurized with inert gas, forcing a jet of molten metal through the orifice onto the rotating wheel. The ejection continues until the crucible is empty, or alternatively until not enough molten metal remains in the crucible to couple the rf heating efficiently, and the orifice clogs.

D. Magnetic Separation

A laboratory electromagnet was built for the magnetic separation. The laboratory electromagnet utilized a 3 centimeter long by 3 centimeter diameter iron bar wrapped with 200 turns of 26 AWG copper wire. The power supply to the electro-magnet was a 10 volt-1 ampere D.C. power supply.

Ribbon fragments, prepared as described above, were separated by sieving into a minus 1.2 millimeter fraction, a 1.2 to 1.98 millimeter fraction, and a plus 1.98 millimeter fraction. The 1.2 to 1.98 millimeter fraction was then magnetically separated into enhanced magnetic parameter and low magnetic parameter fractions. The low magnetic parameter flakes were drawn to the electromagnet and the enhanced parameter flakes were left behind in the first pass. Approximately 90 percent of flakes left behind had an energy product greater than 15 MGOe.

Magnetic separation can be carried out sequentially, with increasing magnetic field, H, on each pass. In this way the demarcation between the materials having relatively high magnetic parameters at substantially complete magnetization (and left behind by the weak magnetic field used for the separation) and the material having relatively lower magnetic parameters at substantially complete magnetization (and removed by the weak magnetic field used for the separation) was increased on each succeeding pass with increasing magnetic field, H. FIG. 5 clearly shows this result for the flake materials of samples MS265 and 491 AC 22.

FIG. 5 shows the pellet energy product versus magnetizer current (and, therefore field, H, and field parameters, as Grad H and H Grad H) for a series of successive magnetic separations at increasing field, H. Seven separations at successively higher magnetic fields, H, of material from sample MS265 resulted in recovering material of successively higher energy product in the high magnetic parameter material left behind by the low magnetic field used for the separation. Eight separations at successively higher fields, H, of material from sample 491 AC 22 resulted in recovering material of successively higher energy product in the high parameter material left behind by the low magnetic field used for the separation.

FIG. 5 clearly shows that ferromagnetic materials can be separated into successively higher energy product fractions by successively magnetizing materials left behind in a prior low field magnetic separation, and that the method of the invention can be used to separate materials that are relatively closed in magnetic parameters (at substantially complete magnetization) into fractions by magnetic separation with a low magnetic field.

E. Pelletization

The separated flakes were crushed to a fine powder. These fines were then mixed with three weight percent of Locktite binder and pressed into pellets in a 2.5 millimeter diameter by 10.0 millimeter length die. Pressing was at 150,000 pounds per square inch. the resulting pellets weighed approximately 1.00 milligrams each.

F. Magnetic Measurements

Measurements of magnetic properties were made using a Model 9500 computer-controlled vibrating-sample magnetometer (VSM) manufactured by LDJ, Inc., having a maximum applied magnetic field of 22 kOe. The values of magnetic field H were determined under feedback-control with a calibrated Hall probe. The measurement software was modified in-house to permit measurement of both major and minor hysteresis loops of permanent magnet materials with high coercive forces. Before every set of measurements, the calibration of the magnetization M was checked using a standard (soft magnetic) nickel sphere (from the U.S. National Bureau of Standards) of measured weight. The calculation of the magnetization of the magnetic materials required a measurement of the sample mass (of order one milligram or less for a typical ribbon particle of order 5 mm long by 2 mm wide by 30 to 50 microns thick) using a Cahn-21 automatic electrobalance (with precision to 1 microgram), and an estimate of the density. For the materials in the examples to be presented below, the density was consistently taken to be the value of 7.6 grams/cc appropriate for pure stoichiometric $Nd_2Fe_{14}B$.

The pellet was pre-magnetizated in a given direction using a pulsed magnetic field (of peak magnitude up to 120 kOe) produced by an LDJ Inc. capacitance discharge magnetizer. This was often necessary to achieve proper magnetic measurements of the high-performance permanent magnet material of the invention, since the maximum field of the VSM magnet was generally insufficient to obtain complete saturation of the magnetic moments. Following this, the sample was mounted in the gap of the magnet of the VSM and positioned at the saddle point of the detection coils. Following standard procedures, pre-magnetized samples were saddled in zero applied field. The measurement was carried out by ramping the field from zero to a maximum (typically 22 kOe), through zero again to a negative maximum, and then back through zero to the positive maximum again, while the entire hysteresis loop was recorded (magnetization M vs. applied magnetic field H). The program then determined the chief magnetic parameters: the remanent magnetization or remanence M (the positive y-intercept of the hysteresis curve), measured in units of kilogauss, the intrinsic coercive force or coercivity $H_c$ (the negative x-intercept of the hysteresis curve), measured in units of kilooersteds, and the maximum energy product (the maximum negative value of the product of the induction $B=H+M$ and the field H), measured in units of megagaussoersteds.

In each of the following examples the pellets were measured magnetically along the cylinder axis.

In each case, the sample was pre-magnetized (pulsed) along the cylinder axis using the pulsed magnetic field.

Figure 6:
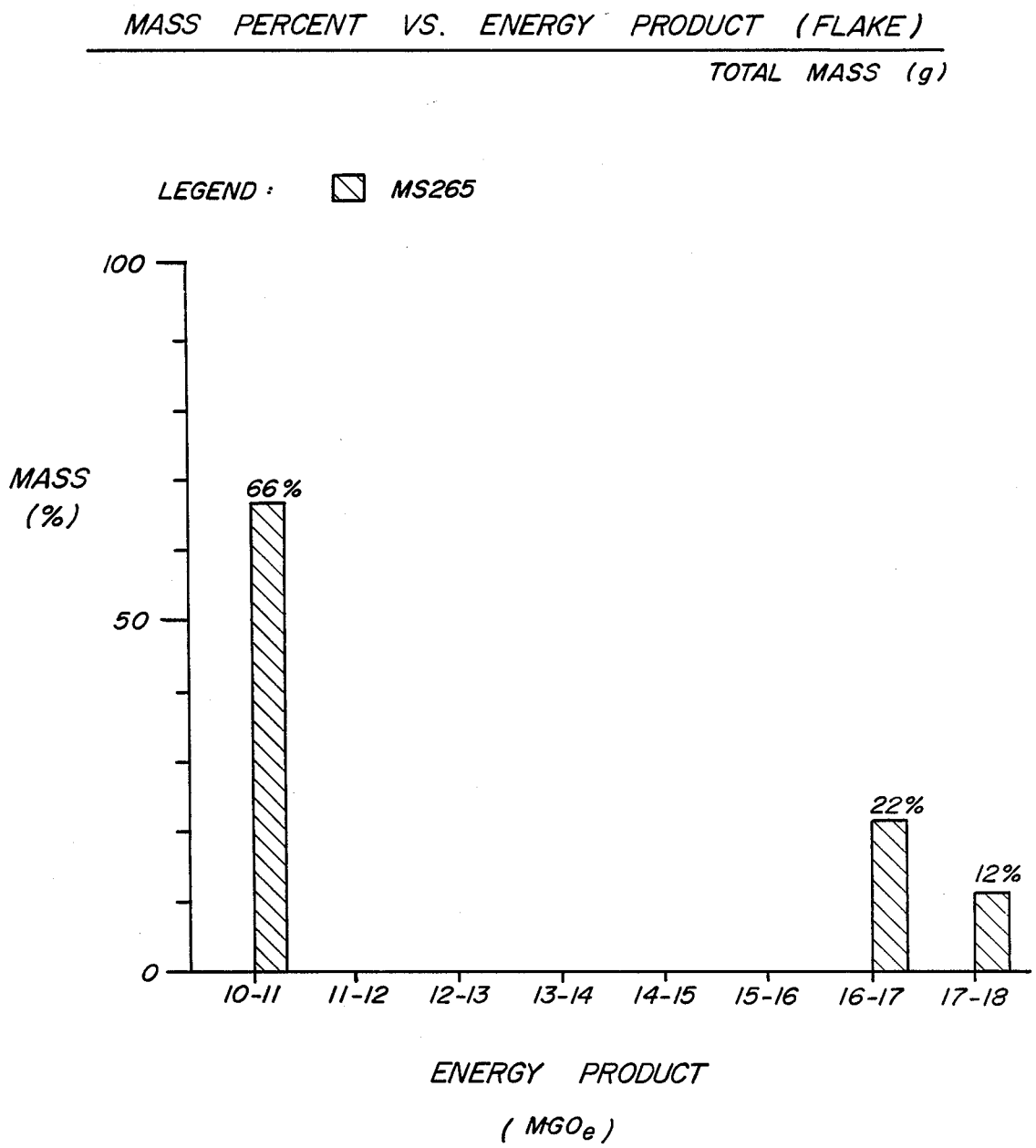
FIG. 6 is a histogram of the energy product versus weight fraction for the sample number MS265 material.

A series of tests were conducted to determine the effect of classifying based upon particle size and subsequent magnetic separation. Samples MS 265 and MS 265 HT were prepared as described above by and obtained from Nippon Steel Company. Sample MS 265 HT had been heat treated after solidification. FIG. 6 shows a histogram of mass percent of material versus energy product for flakes and particles of the material of sample MS265 (Table IC). This Figure, especially when taken with FIG. 5, above, and the data in Table IC, below, shows the ability of the magnetic separation method of the invention to differentiate between:

(1) material having a relatively low energy product at substantially complete magnetization, here 10–11 megagaussoersteds, and material having a relatively high energy product at substantially complete magnetization, here above 15 megagaussoersteds; and (2) within the class of material having a relatively high energy product, here above 15 megagaussoersteds, between materials having successively higher energy products, here a. a 15–16 megagaussoersted fraction, b. a 16–17 megagaussoersted fraction, and c. a 17–18 megagaussoersted fraction.

The following results were obtained.

TABLE IA

| Particle Size Range (mm) | Melt Spun Ribbon Particles (Sample 491AC22 530AP08) Enhanced Parameter Weight (gms) | Enhanced Parameter Fraction (%) | Over Quenched Weight (gms) | Over Quenched Fraction (%) |
|---|---|---|---|---|
| *LT 1.20 | 18.24 | 9.17 | 111.00 | 55.78 |
| 1.20–1.98 | 6.24 | 3.14 | 62.15 | 31.23 |
| **GT 1.98 | 0.01 | 0.00 | 1.35 | 0.68 |
| Subtotal | 24.49 | 12.31 | 174.50 | 87.69 |

TABLE IB

| Particle Size Range (mm) | Melt Spun Ribbon Particles (Sample MS265HT) Enhanced Parameter Weight (gms) | Enhanced Parameter Fraction (%) | Over Quenched Weight (gms) | Over Quenched Fraction (%) |
|---|---|---|---|---|
| *LT 1.20 | 26.74 | 28.18 | 28.42 | 29.95 |
| 1.20–1.98 | 21.75 | 22.92 | 16.83 | 17.74 |
| **GT 1.98 | 0.12 | 0.13 | 1.02 | 1.08 |
| Subtotal | 48.61 | 51.23 | 46.27 | 48.77 |

* = Less than
** = Greater than

TABLE IC

| Particle Size Range (mm) | Melt Spun Ribbon Particles (Sample MS265) Enhanced Parameter Weight (gms) | Enhanced Parameter Fraction (%) | Over Quenched Weight (gms) | Over Quenched Fraction (%) |
|---|---|---|---|---|
| *LT 1.20 | 10.44 | 8.12 | 51.51 | 40.07 |
| 1.20–1.98 | 33.23 | 25.85 | 32.81 | 25.52 |
| **GT 1.98 | 0.20 | 0.16 | 0.37 | 0.28 |

TABLE IC-continued

| Particle Size Range (mm) | Melt Spun Ribbon Particles (Sample MS265) Enhanced Parameter Weight (gms) | Enhanced Parameter Fraction (%) | Over Quenched Weight (gms) | Over Quenched Fraction (%) |
|---|---|---|---|---|
| Subtotal | 43.87 | 34.13 | 84.69 | 65.87 |

* = Less than
** = Greater than

A series of tests were conducted to show the effects of magnetic separation on the properties of pelletized materials. The magnetic flakes were prepared and separated as described above, and the resulting enhanced parameter flakes were pelletized as described above. The following results were obtained:

TABLE II

| Lab Sample Number | Percent Enhanced Parameter | Pellet Properties Highest Energy Product (MegaGauss-Oersted) | Lowest Energy Product (MegaGaussOersted) |
|---|---|---|---|
| 491AD04 | 18.0 | 16.33 | 15.95 |
| 491AD03 | 2.9 | 16.32 | 16.32 |
| 491AC23 | 5.9 | 16.40 | 15.89 |
| 502AB01 | 6.9 | 16.99 | 16.20 |
| 538AA01 | 1.8 | 16.55 | 16.25 |
| MS265 | 34.0 | 17.48 | 16.57 |
| MS265HT | 45.0 | 17.00 | 16.11 |

While the invention has been described with respect to certain preferred exemplifications and embodiments thereof, it is not intended to limit the scope of the invention thereby, but solely by the claims appended hereto.

We claim:

1. A method of forming a high energy product ferromagnetic alloy of the transition metal-rare earth-boron type having a tetragonal crystal structure with a $P4_2/mnm$ space group, from a molten precursor thereof comprising the steps of:

(a) solidifying the presursor alloy to form a particulate solid alloy having a distribution of crystallographic grain sizes corresponding to magnetic energy products at complete magnetization, said distribution including at least:

(1) a first grain size corresponding to a relatively high magnetic energy product material at complete magnetization and (2) a second grain size corresponding to a relatively low magnetic energy product material at complete magnetization;

(3) said relatively high magnetic energy product material having a lower induced magnetization at low strength applied magnetic fields and a higher induced magnetization at high strength magnetic fields than said low magnetic energy product material;

(b) classifying the particulate solid alloy into portions by particle size said classified portions containing a distribution of crystallographic grain sizes;

(c) applying a low strength magnetic field to a classified portion of the particulate solid alloy, the low strength applied magnetic field inducing a higher induced magnetization in the low magnetic energy product particles than in the high magnetic energy product particles; and (d). magnetically removing the low magnetic energy product particles from the high magnetic energy product particles.

2. The method of claim 1, wherein the alloy includes high magnetic energy product materials having a crystallographic grain size corresponding to a relatively high magnetic energy product and overquenched materials having a grain size corresponding to a relatively low magnetic energy product.

3. The method of claim 1 wherein the ferromagnetic alloy is of the $RE_2Fe_{14}B_1$ type where RE represents a rare earth metal.

* * * * *